US010879628B2

(12) United States Patent
Lybrand

(10) Patent No.: US 10,879,628 B2
(45) Date of Patent: Dec. 29, 2020

(54) WIRE-TO-WIRE CONNECTOR WITH INTEGRATED WIRE STOP

(71) Applicant: AVX Corporation, Fountain Inn, SC (US)

(72) Inventor: Brent Lybrand, Fountain Inn, SC (US)

(73) Assignee: AVX Corporation, Fountain Inn, SC (US)

( * ) Notice: Subject to any disclaimer, the term of this patent is extended or adjusted under 35 U.S.C. 154(b) by 0 days.

(21) Appl. No.: 16/601,149

(22) Filed: Oct. 14, 2019

(65) Prior Publication Data

US 2020/0044370 A1 Feb. 6, 2020

Related U.S. Application Data

(63) Continuation of application No. 16/012,116, filed on Jun. 19, 2018, now Pat. No. 10,468,787.

(60) Provisional application No. 62/529,643, filed on Jul. 7, 2017.

(51) Int. Cl.

| | |
|---|---|
| ***H01R 4/20*** | (2006.01) |
| ***H01R 4/64*** | (2006.01) |
| ***H01R 4/50*** | (2006.01) |

(52) U.S. Cl.

CPC ..... *H01R 4/206* (2013.01); *H01R 4/5066* (2013.01); *H01R 4/646* (2013.01)

(58) Field of Classification Search

CPC ..... H01R 4/206; H01R 4/5066; H01R 4/646; H01R 4/72; H01R 4/723; H01R 4/726

USPC ..... 439/730, 948; 339/95, 217

See application file for complete search history.

(56) References Cited

U.S. PATENT DOCUMENTS

| | | | | |
|---|---|---|---|---|
| 3,006,983 | A * | 10/1961 | McDurmont | H01R 4/20 174/94 R |
| 3,288,914 | A | 11/1966 | Glenwood et al. | |
| 3,530,428 | A | 9/1970 | Zak et al. | |
| 3,924,057 | A | 12/1975 | Sosinski | |
| 3,937,548 | A * | 2/1976 | Dittmann | H01R 4/4845 439/436 |

(Continued)

FOREIGN PATENT DOCUMENTS

| | | | |
|---|---|---|---|
| CN | 102165643 | A | 8/2011 |
| CN | 102195202 | A | 9/2011 |
| JP | 2011-175867 | A | 9/2011 |

OTHER PUBLICATIONS

Non-Final Office Action on U.S. Appl. No. 16/012,116 dated Feb. 6, 2019.

*Primary Examiner* — Peter G Leigh
(74) *Attorney, Agent, or Firm* — Foley & Lardner LLP

(57) ABSTRACT

A system includes a housing and a contact portion. The housing includes a first portion and a second portion, the first portion interlocking with the second portion so as to enclose a first volume and form a first wire opening within a first end of the housing and a second wire opening within a second end of the housing. The contact portion is disposed within the first volume and includes a first wire receiving portion, a first flexing beam extending from a first surface of the first wire receiving portion towards a second surface of the first wire receiving portion, a second wire receiving portion, a second flexing beam extending from a first surface of the second wire receiving portion towards a second surface of the second wire receiving portion, and a common wire stop disposed between the first wire receiving portion and the second wire receiving portion.

20 Claims, 9 Drawing Sheets

(56) References Cited

U.S. PATENT DOCUMENTS 4,084,876 A * 4/1978 Dinger ..... H01R 4/4818 439/439
4,508,409 A * 4/1985 Cherry ..... H01R 4/2491 174/84 R
4,973,263 A * 11/1990 Nielsen ..... G05B 19/0423 439/438
5,019,674 A * 5/1991 Greene ..... H01R 4/2433 174/84 C
5,369,225 A * 11/1994 Natwig ..... H01R 4/723 174/84 R
5,393,932 A * 2/1995 Young ..... H01Q 1/244 174/84 R
5,868,590 A 2/1999 Dobbelaere
6,168,457 B1 1/2001 Kim
6,402,571 B1 6/2002 Muller et al.
6,769,931 B2 * 8/2004 Negishi ..... H01R 4/2433 439/402
7,153,170 B1 12/2006 Fabian
7,256,348 B1 * 8/2007 Endacott ..... H01R 4/183 174/84 C
7,384,319 B2 * 6/2008 Kirstein ..... H01R 4/4818 439/439
7,704,095 B2 * 4/2010 Stromiedel ..... H01R 4/4818 439/436
7,722,384 B2 * 5/2010 Breen, IV ..... H01R 4/22 439/441
7,867,013 B2 * 1/2011 Cox ..... H01R 4/2433 439/404
8,062,056 B2 * 11/2011 Lee ..... H01R 4/2433 439/395
8,262,405 B1 * 9/2012 Bishop ..... H01R 4/4845 439/439
8,512,066 B2 * 8/2013 Lee ..... H01R 4/2433 439/395
8,579,650 B2 * 11/2013 Keswani ..... H01R 4/4818 439/441
8,986,054 B2 3/2015 Stadler et al.
9,391,386 B2 7/2016 Bishop
9,472,871 B2 10/2016 Lin et al.
9,647,368 B2 5/2017 Davies et al.
2007/0100325 A1 5/2007 Jutras et al.
2008/0108241 A1 5/2008 Kocher et al.
2009/0117775 A1 5/2009 Kocher et al.
2010/0029129 A1 2/2010 Cox et al.
2012/0238154 A1 9/2012 Bishop
2013/0029529 A1 1/2013 Osagie et al.
2014/0242833 A1 8/2014 Mostoller et al.
2016/0087359 A1 3/2016 Fu et al.

* cited by examiner

WIRE-TO-WIRE CONNECTOR WITH INTEGRATED WIRE STOP

CROSS-REFERENCE TO RELATED APPLICATIONS

This application is a continuation of U.S. patent application Ser. No. 16/012,116, filed Jun. 19, 2018, which claims priority to U.S. Provisional Patent Application No. 62/529,643, filed Jul. 7, 2017, the contents of each of which are incorporated herein by reference in their entirety.

FIELD

The present application relates generally to the field of electrical connectors, and more particularly to a type of connector used to electrically connect one wire to at least one other wire.

BACKGROUND

The following description is provided to assist the understanding of the reader. None of the information provided or references cited are admitted to be prior art.

Various types of connectors are used for forming connections between a wire and any manner of electronic or electrical component. These connectors are typically available as sockets, plugs, and shrouded headers in a vast range of sizes, pitches, and plating options. Traditionally, for two wires to be connected together, a user must strip the first and second wires, twist the two ends together, and then secure them to one other. This process can be tedious, inefficient, and undesirable. Furthermore, a wire-to-wire connection that may fall apart or short out unexpectedly could be hazardous or even deadly. Thus, a quick, efficient, and reliable means of connecting and disconnecting wires is needed.

SUMMARY

The systems, methods and devices of this disclosure each have several innovative aspects, no single one of which is solely responsible for the desirable attributes disclosed herein.

A contact portion for a wire-to-wire connector includes a first wire receiving portion, a second wire receiving portion, and a common wire stop. The first wire receiving portion includes a first surface and a second surface extending from an end of the first wire receiving portion. The first wire receiving portion further includes a first flexing beam extending from the first surface of the first wire receiving portion towards the second surface. The second wire receiving portion includes a first surface and a second surface extending from an end of the second wire receiving portion. The second wire receiving portion further includes a second flexing beam extending from the first surface of the second wire receiving portion towards the second surface. In an embodiment, the common wire stop is disposed between the first wire receiving portion and the second wire receiving portion.

In an embodiment, the first and second flexing beams of the contact portion extend from bends in the first surfaces of the first and second wire receiving portions. Additionally, the first flexing beam includes a first end and the second flexing beam includes a second end. The first and second ends are displaced from the second surfaces of the first and second wire receiving portions to form gaps between the first and second ends and the second surfaces.

In an embodiment, the first surface of the first wire receiving portion is disposed on a first side of the contact portion and the first surface of the second wire receiving portion is disposed on a second side of the contact portion. Further, in such an embodiment, the first flexing beam extends in a first direction towards the second side of the contact portion and the second flexing beam extends in a second direction towards the first side of the contact portion. In an embodiment, the second surfaces of the first and second wire receiving portions each include a proximal portion and a distal portion. The proximal portions have a lesser height than the distal portions.

Moreover, the common wire stop includes a first wire stop portion and a second wire stop portion. In an embodiment, the first wire stop portion abuts the second wire stop portion at about a central axis of the contact portion. Further, the first wire stop portion extends from the second surface of the first wire receiving portion towards the second surface of the second wire receiving portion and the second wire stop portion extends from the second surface of the second wire receiving portion towards the second surface of the first wire receiving portion such that the first and second wire stop portions overlap. In an alternative embodiment, the first wire stop portion is substantially co-planar to the second wire stop portion in a direction substantially parallel to the central axis of the contact portion.

The contact portion also includes a base portion extending from the end of the first wire receiving portion to the end of the second wire receiving portion. The first and second surfaces of the first and second wire receiving portions are each connected to the base portion and extend in a direction substantially perpendicular to a surface the base portion. Moreover, the first wire receiving portion includes a first cover portion, the first cover portion being connected to the second surface of the first wire receiving portion and extending in a direction substantially parallel to the surface of the base portion. The second wire receiving portion also includes a second cover portion, the second cover portion being connected to the second surface of the second wire receiving portion and extending in the direction substantially parallel to the surface of the base portion.

A system includes a housing and a contact portion. The housing includes a first portion and a second portion, the first portion interlocking with the second portion so as to enclose a first volume and form a first wire opening within a first end of the housing and a second wire opening within a second end of the housing. The contact portion is disposed in the first volume and is constructed of an electrically-conductive material. The contact portion includes a first wire receiving portion, a second wire receiving portion, and a common wire stop. The first wire receiving portion encloses a second volume that extends from the first wire opening. The first wire receiving portion includes a first flexing beam extending from a first surface of the first wire receiving portion towards a second surface of the first wire receiving portion. The second wire receiving portion encloses a third volume that extends from the second wire opening. The second wire receiving portion includes a second flexing beam extending from a first surface of the second wire receiving portion towards a second surface of the second wire receiving portion. The common wire stop is disposed between the first wire receiving portion and the second wire receiving portion. In an embodiment, there is a first gap between the first wire opening and the second volume enclosed by the first wire receiving portion and a second gap between the second wire opening and the third volume enclosed by the second wire receiving portion.

Moreover, the first portion of the housing includes a first set of latching prongs and a first set of connection cutout portions disposed on a first side of the housing. The first portion also includes a second set of latching prongs and a second set of connection cutout portions disposed on a second side of the housing. The first sets of latching prongs and connection cutouts are offset from the second sets of latching prongs by a distance in the direction of the axis. Additionally, the second portion of the housing includes a first set of latching prongs and a first set of connection cutout portions disposed on the first side of the housing. The second portion of the housing also includes a second set of both latching prongs and a second set of connection cutout portions disposed on the second side of the first portion. The first sets of latching prongs and connection cutouts are offset from the second sets of latching prongs by the distance in the direction of the axis. In an embodiment, the latching prongs of the first portion of the housing are engaged with the connection cutout portions of the second portion of the housing to secure the first portion of the housing to the second portion of the housing. In an embodiment, the first and second sets of latching prongs and connection cutout portions of both the first and second portions of the housing include two latching prongs and two connection cutout portions.

Moreover, the first end includes a first outer surface. The first outer surface includes a planar portion and a circular angled portion, the planar portion circumferentially surrounds the planar portion. The first wire opening is within the angled portion. The second end includes a second outer surface. The second outer surface includes a planar portion and a circular angled portion, the planar portion circumferentially surrounds the planar portion. The second wire opening is within the angled portion. In an embodiment, the first wire opening is of a first diameter and the second wire opening is of a second diameter, the second diameter being different from the first diameter.

A wire-to-wire connector may be used to electrically couple a first wire to a second wire. For example, an end of the first wire is inserted through a first wire opening of a housing of a wire-to-wire connector. The first end is pressed against a first flexing beam of a first wire receiving portion of a contact portion of the wire-to-wire connector until a portion of the first end slides through a gap between the first flexing beam and a surface of the first wire receiving portion. The common wire stop is disposed between the first wire receiving portion and a second wire receiving portion of the contact portion. A second end of the second wire extends through a second wire opening of the housing. The second end is pressed against a second flexing beam of the second wire receiving portion of the contact portion of the until a portion of the second end slides through a gap between the second flexing beam and a surface of the second wire receiving portion. The contact portion is constructed of an electrically-conductive material. The flexing beams press the first and second wires against the surfaces of the first and second wire receiving portions so as to retain the first and second wires in the contact portion and create an electrically-conductive connection between the first wire and the second wire.

DETAILED DESCRIPTION

Reference will now be made to various embodiments, one or more examples of which are illustrated in the figures. The embodiments are provided by way of explanation of the invention, and are not meant as a limitation of the invention. For example, features illustrated or described as part of one embodiment may be used with another embodiment to yield still a further embodiment. It is intended that the present application encompass these and other modifications and variations as come within the scope and spirit of the invention.

Disclosed herein is a wire-to-wire connector that includes a housing and a contact portion including a flexing beam and a wire stop. The flexing beam may include a curved cutout on a distal end of the flexing beam to facilitate engagement of the flexing beam with a corresponding electrical element (e.g., conductive core of a wire) between the flexing beam and correspond contact surface. Such a wire-to-wire connector may be used to efficiently and reliably mechanically and electrically couple one or more wires to each other. Specifically, the wire-to-wire connector allows for efficient and rapid creation of an electrical and mechanical connection between a conductive portion of a wire and the contact portion of the wire-to-wire connector without soldering or crimping the wire. Additionally, the wire stop prevents over-insertion of the wires, thus ensuring a reliable connection between the wires. Furthermore, the unique design of the contact portion of the wire-to-wire connector disclosed herein allows for the contact portion to be constructed out of a single piece of material. This construction minimizes the number of components that must be connected to one another, and thus simplifies the manufacturing process.

Various embodiments of a wire-to-wire connector are illustrated throughout FIGS. 1 through 4. The wire-to-wire connector disclosed in these figures is configured to mechanically and electrically connect a first wire to a contact portion that also has an electrical connection with at least one additional wire. As such, the at least two wires share an electrical connection with another. Furthermore, the housing may house a number of contact portions, enabling any number electrical connections (e.g., two, four, six, etc.) to be formed between any number of wires. It should be appreciated that the wire-to-wire connectors disclosed herein are not limited by a maximum number of wire positions, contact portions, or wire stops.

Figure 1A:
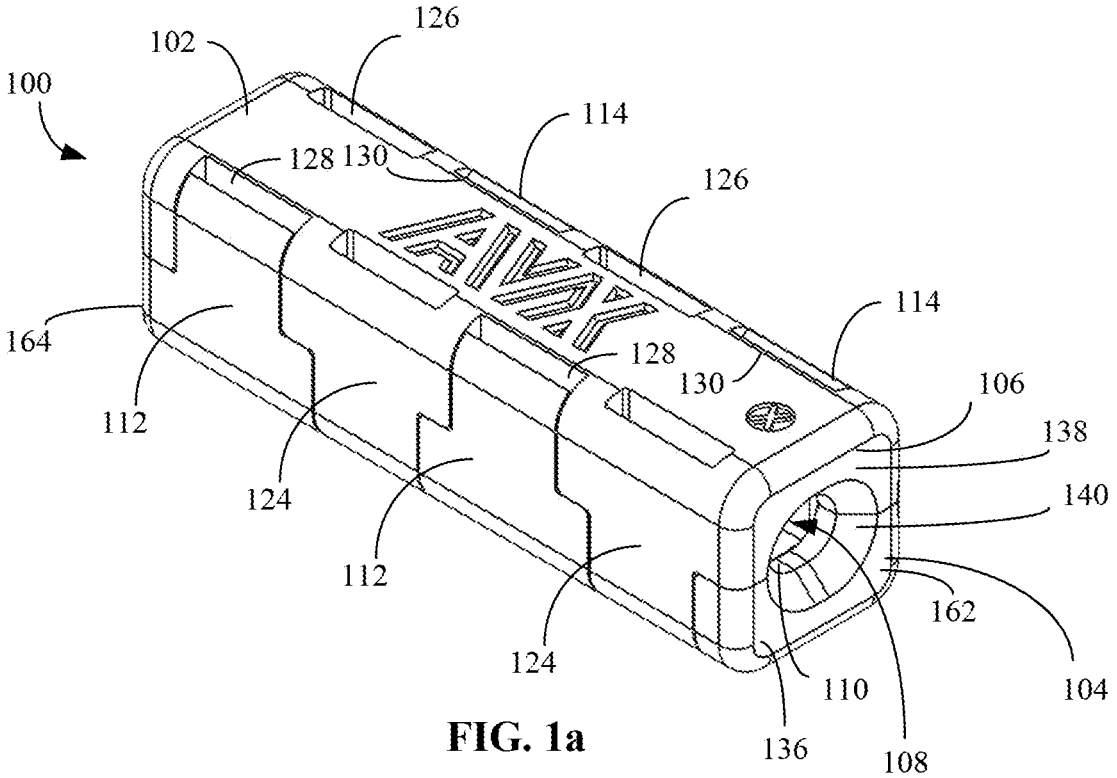
FIG. 1*a* depicts an isometric view of a wire-to-wire connector in accordance with an illustrative embodiment.
Figure 1B:
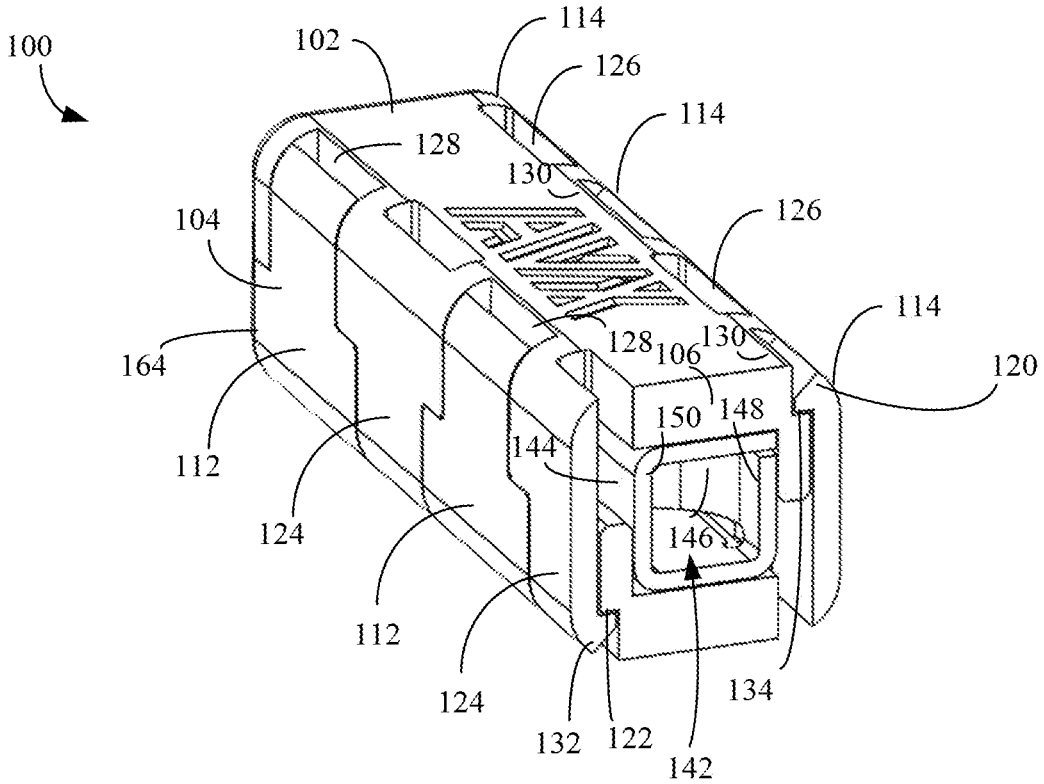
FIG. 1*b* depicts a cross-sectional view of a wire-to-wire connector in accordance with an illustrative embodiment.
Figure 1C:
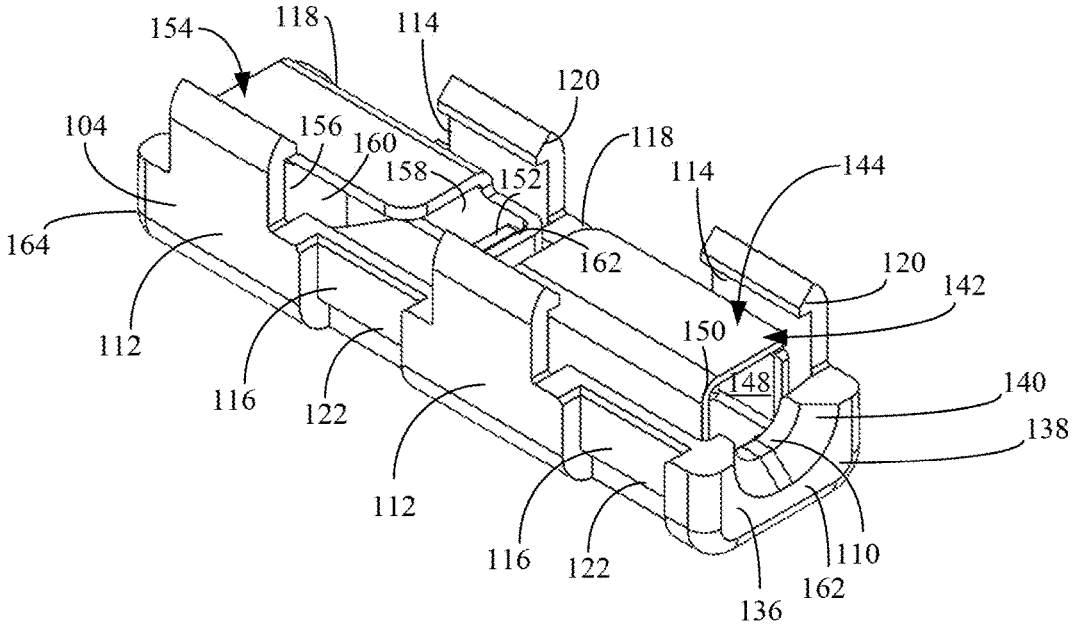
FIG. 1*c* depicts an isometric view of a wire-to-wire connector with a portion of a housing removed therefrom in accordance with an illustrative embodiment.
Figure 1D:
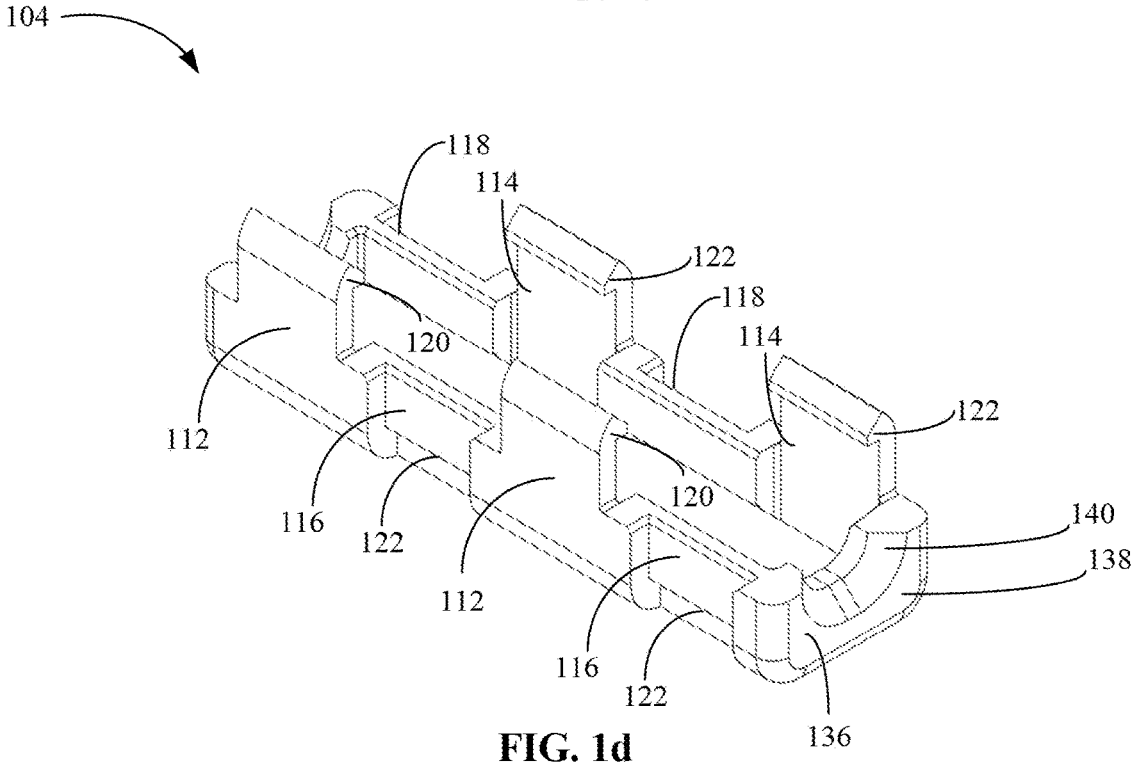
FIG. 1*d* depicts a portion of a housing of a wire-to-wire connector in accordance with an illustrative embodiment.

Referring to FIGS. 1*a* to 1*d* in general, a wire-to-wire connector 100 is depicted as three separable elements in accordance with various illustrative embodiments. FIG. 1*a* depicts an isometric view of the wire-to-wire connector 100 in accordance with an illustrative embodiment. FIG. 1*b* depicts a cross-sectional view of the wire-to-wire connector 100 in accordance with an illustrative embodiment. FIG. 1*c* depicts an isometric view of the wire-to-wire connector 100 with a portion 106 of a housing 102 removed therefrom in accordance with an illustrative embodiment. FIG. 1*d* depicts a portion 104 of the housing 102 of the wire-to-wire connector 100 in accordance with an illustrative embodiment. As generally depicted in FIGS. 1*a* to 1*d*, the wire-to-wire connector 100 includes housing 102 and a contact portion 142. The housing 102 includes a first portion 104 and a second portion 106. In an embodiment, both the first portion 104 and the second portion 106 are constructed from an electrically-insulative material. The first portion 104 interlocks with the second portion 106 to enclose a volume 108 and form a first wire opening 110 at a first end 162 of the housing. While not shown, housing 102 also includes a second wire opening at a second end 164 of the housing 102. In one embodiment, the first and second portions 104 and 106 of the housing 102 are identical to one another. Such a configuration lowers the manufacturing costs associated with the housing 102, as only a single type of housing portion needs to be constructed.

The first portion 104 of the housing includes a first set of latching prongs 112 and a second set of latching prongs 114. In an embodiment, each of the sets of latching prongs 112 and 114 include the same number (e.g., two) latching prongs. In other embodiments, each of the sets of latching prongs 112 and 114 include a different number of latching prongs. In one embodiment, for example, the first set of latching prongs 112 includes three latching prongs while the second set of latching prongs 114 includes two latching prongs. The first portion 104 also includes a first set of connection cutout portions 116 and a second set of connection cutout portions 118. In an embodiment, each of the sets of cutout portions 116 and 118 include the same number connection cutout portions. In various embodiments, the number of cutout portions in the sets of cutout portions 116 and 118 is the same as the number of latching prongs in the sets of latching prongs 112 and 114. In alternative embodiments, the number of cutout portions in the sets of cutout portions 116 and 118 varies from the number of latching prongs in the sets of latching prongs 112 and 114. For example, in one embodiment, the number of latching prongs is greater than the number of connection cutouts.

The first sets of latching prongs and cutout portions 112 and 116 are on a first side of the first portion 104 and the second sets of latching prongs and cutout portions 114 and 118 are on a second side of the first portion 104. In an embodiment, the first set of latching prongs 112 is offset by a distance from the second set of latching prongs 114 in a direction that is substantially parallel to the lengthwise direction of the housing 102. The first set of connection cutout portions 116 is also offset from the second set of connection cutout portions 118 by the distance in direction that is substantially parallel to the lengthwise direction of the housing 102.

In an embodiment, the latching prongs of the first and second sets of latching prongs 112 and 114 and the connection cutout portions of the first and second sets of connection cutout portions 116 and 118 are the same width in the lengthwise direction of the housing 102. In an embodiment, the distance of the offset is within a predetermined threshold of the width of the latching prongs and connection cutout portions. As will become apparent below, such an offset enables a similarly-shaped second portion 106 of the housing 102 to securely engage with the first portion 104 to enclose the volume 108. In alternative embodiments, the width of the latching prongs and connection cutouts differs from the distance of the offsets.

Each of the latching prongs in the first and second sets of latching prongs 112 and 114 include extending portions 120 extending towards the center of the first portion 104. Additionally, each of the connection cutout portions in the first and second sets of connection cutout portions 116 and 118 include connection ridges 122.

The second portion 106 of the housing 102, similar to the first portion 104, includes a first set of latching prongs 124 and a second set of latching prongs 126. In an embodiment, each of the sets of latching prongs 124 and 126 include two latching prongs. The second portion 106 also includes a first set of connection cutout portions 128 and a second set of connection cutout portions 130. In an embodiment, each of the sets of cutout portions 128 and 130 include two cutout portions. The first sets of latching prongs and cutout portions 124 and 128 are on a first side of the second portion 106 and the second sets of latching prongs and cutout portions 126 and 130 are on a second side of the first portion 104. In an embodiment, the first set of latching prongs 124 is offset from the second set of latching prongs 126 in a direction that is substantially parallel to the lengthwise direction of the housing 102. The first set of connection cutout portions 128 is also offset from the second set of connection cutout portions 130 in the direction that is substantially parallel to the lengthwise direction of the housing 102.

In an embodiment, the number of latching prongs in the first set of latching prongs 124 of the second portion 106 is equivalent to the number of connection cutout portions in the first set of connection cutout portions 116 of the first portion 104. Additionally, the number of latching prongs in the second set of latching prongs 126 is equivalent to the number of connection cutout portions in the second set of connection cutout portions 118 of the first portion 104. Such equivalence enables the first portion 104 to securely interlock with the second portion 106.

Also similar to the first portion 104, each of the latching prongs in the first and second sets of latching prongs 124 and 126 include extending portions 132 extending towards the center of the second portion 106. Additionally, each of the connection cutout portions in the first and second sets of connection cutout portions 128 and 130 include connection ridges 134.

In an embodiment, to assemble the wire-to-wire connector 100, the contact portion 142 is inserted into the first portion 104 of the housing 102 (e.g., as shown in FIG. 1*c*). Next, the first portion 104 is vertically aligned with the second portion 106 such that the first set of latching prongs 112 of the first portion 104 align with the first set of connection cutout portions 128 of the second portion 106. As a result of such an alignment, the second set of latching prongs 114 of the first portion 104 also aligns with the second set of connection cutout portions 130 of the second portion 106. The first portion 104 and the second portion 106 are then pressed together until each of the extending portions 120 of the first portion 104 engage with the connection ridges 134 of the second portion 106 and each of the extending portions 132 of the second portion 106 engage with the connection ridges 122 of the first portion 104. As a result, the first portion 104 is securely interlocked to the second portion 106. Accidental disassembly of the housing 102 is thus prevented.

In an embodiment, to disassemble the housing 102, one, for example, may disengage the latching portions of the first portion 104 from the connection cutout portions of the second portion 106 by, for example, applying an outward force to at least one of the latching portions (e.g., by pulling away from the center of the housing 102). Such a force causes the extending portion 120 to disengage with the connection ridge 134, and enables the first portion 104 to be swiftly removed from the second portion 106. Thus, the unique design of the housing 102 disclosed herein enables quick and easy assembly and disassembly. As a result, the housing 102 may be quickly swapped out for another housing or the contact portion 142 may be replaced.

It should be noted that alternative housings are envisioned. For example, another housing may include a first portion that substantially encloses a volume and a second portion at an end of the first portion. The second portion may attach (e.g., via a hinge) to the first portion at the end such that the housing substantially encloses a volume. This way, the contact portion 142 may be inserted into the first portion, and then covered by the second portion. In another embodiment, the housing is constructed of an open-ended sleeve of insulative material. Any suitable form of housing is consistent with the wire-to-wire connector disclosed herein.

While the housing 102 is shown in FIGS. 1*a*-1*d* to only contain a single contact portion 142, it should be understood that alternative configurations are envisioned. In various embodiments, the first and second portions 104 and 106 of the housing 102 may be sized to enclose a volume into which any number of contact portions (e.g., similar to the contact portion 142) may be inserted. For example, in one embodiment, the housing is sized such that the length of each latching prong in the of the sets of latching prongs 112, 114, 124, and 126 is approximately doubled and that the width of the housing 102 is approximately doubled. This way, the volume 108 enclosed by the housing 102 when the first portion 104 interlocks with the second portion 106 is approximately quadrupled. In such an embodiment, the first end 162 and the second end 164 may include four wire openings (e.g., similar to the wire opening 110). This way, the volume could include four separate contact portions. The contact portions may be stacked directly on one another. In this case, because the contact portions may be constructed of an electrically-conductive material, each wire inserted into one of the contact portions is electrically connected to all of the other wires. Thus, this arrangement allows for efficiently establishing an electrical connection between a large number of wires.

Alternatively, insulating material may be placed between the number of contact portions inserted into the volume 108. This way, a number of different wire pairs may be connected to one another in a single unit.

In some embodiments, the contact portions inserted into the housing 102 are differently oriented. For example, while one contact portion may be oriented in a manner similar to the contact portion 142 (i.e., extending lengthwise between the first and second ends 162 and 164), another contact portion may be oriented in a substantially perpendicular fashion (e.g., extending lengthwise between the set of latching prongs 112 and connection cutout portions 118). As will be appreciated, in such an embodiment, the latching prongs and/or connection cutout portions of the first and second portions 104 and 106 of the housing 102 may include wire openings (e.g., similar to the wire opening 110). Additionally, the relative dimensions of the first and second portions 104 and 106 of the housing may be different to accommodate differently-oriented contact portions. Such an arrangement facilitates interconnecting multiple pairs of wires from different directions within a single unit.

Still referring generally to FIGS. 1*a*-1*d*, the first end 162 of the housing 102 further includes an outer surface 136. In various embodiments, the outer surface 136 includes a planar portion 138 and an angled portion 140. In an embodiment, the angled portion 140 is circular. In another embodiment, the angled portion 140 is square-shaped. In various embodiments, the angled portion 140 may include any suitable shape that corresponds to a desired shape of the wire opening 110. In some embodiments, the planar portion 138 may be replaced with a non-planar surface. For example, in one embodiment, the planar portion 138 may be shaped as a section of a sphere or cylinder.

In an embodiment, the planar portion 138 circumferentially surrounds the angled portion 140 and the first wire opening 110 is disposed within the angled portion 140. Since the angled portion 140 extends inwardly towards the center of the housing 102, the angled portion 140 aids in the insertion of wires through the wire opening 110. Rather than having to precisely align the wire with the wire opening 110, all the user needs to do is align the wire with the combination of the angled portion 140 and wire opening 110 and apply a force to the wire towards the center of the housing 102. If the user misses the wire opening 110, the angled portion 140 guides the wire through the wire opening 110. Thus, the angled portion 140 supports easy operation of the wire-to-wire connector 100.

In various embodiments, the housing 102 includes a second wire opening (not shown) at the second end 164 of the housing that is opposite to the first end 162. In an embodiment, the second wire opening is the same shape as the first wire opening. For example, both the first wire opening 110 and the second opening may be substantially circular and of the same diameter to facilitate the connection of similarly-sized wires. Alternatively, the first wire opening 110 may be of a different size (e.g., a smaller or larger diameter) than the second wire opening to facilitate the interconnection of differently sized wires. In some embodiments, the first wire opening 110 is shaped differently than the second wire opening. For example, in one embodiment, the first wire opening 110 is substantially square-shaped while the second wire opening is circular. It should be understood that any shape/size combination of wire holes is possible in accordance with the wire-to-wire connector disclosed herein.

Referring generally to FIG. 1*c*, the contact portion 142 includes a first wire receiving portion 144 and a second wire receiving portion 154. The first wire receiving portion 144 includes an opening at a first end of the contact portion 142 that is disposed proximate to the first wire opening 110 of the housing 102. In some embodiments, the first end of the contact portion 142 is flush with the first end 162 of the housing 102. In an alternative embodiment, there is a gap between the first end of the contact portion 142 and the first end 162 of the housing 102. In various embodiments, the second wire receiving portion 154 includes an opening that is similarly situated to the second end 164 of the housing. The openings in the first and second wire receiving portions 144 and 154 are structured to receive wires when wires are inserted through the wire openings (e.g., the first wire opening 110) in the housing 102.

The first wire receiving portion 144 includes a first surface 148 and a second surface 150. In an embodiment, both the first surface 148 and the second surface 150 extend from the first end of the first wire receiving portion 144 towards the center of the contact portion 142. The first wire receiving portion 144 further includes a first flexing beam 146 (see e.g., FIG. 1*b*) that extends from the first surface 148 towards the second surface 150. The second wire receiving portion 154, similar to the first wire receiving portion 144, includes a first surface 156, a second surface 158, and a second flexing beam 160 that extends from the first surface 156 towards the second surface 158. As will become more apparent with the description below, the flexing beams 160 and 146 facilitate the mechanical and electrical connection of wires inserted into the openings of the first and second wire receiving portions 144 and 154.

In one embodiment, both the first wire opening 110 and the second wire opening are oval or substantially-oval shaped (e.g., elliptically shaped). This allows one to provide clearance for inserted wires to slide within the opening along a single direction to maximize the contact surface between the wire and the contact portion 142. For example, in one embodiment, the major axis of the first wire opening 110 extends between the first surface 148 and the second surface 150 of the first wire receiving portion 144 and the major axis of the second wire opening extends between a first surface 156 and a second surface 158 of the second wire receiving portion 154. Such a configuration facilitates the electrical and mechanical connection of inserted wires to the contact portion 142. Since the major axes of the wire openings extend the distances between the surfaces of the first and second wire receiving portions 144 and 154, the wire needn't be bent to contact the surfaces 150 and 158. In other words, the ovular-shaped wire openings facilitate the flexing beams 160 and 146 forcing inserted wires against the surfaces 150 and 158 without bending the wires, because the wires may slide along the major axes. Such a configuration maximizes the contact surface between the wires and the contact portion 142, thereby facilitating the electrical connection between the inserted wires.

In various embodiments, the contact portion 142 also includes a common wire stop disposed between the first and second wire receiving portions 144 and 154. The common wire stop may include a first wire stop portion 152 and a second wire stop portion 162. In some embodiments, the first wire stop portion 152 extends from the second surface 150 of the first wire receiving portion 144 towards the second surface 158 of the second wire receiving portion 154 and the second wire stop portion 162 extends from the second surface 158 of the second wire receiving portion 154 towards the second surface 150 of the first wire receiving portion 144. In an embodiment, the first and second wire stop portions 152 and 156 include substantially planar surfaces extending in a direction perpendicular to the second surfaces 150 and 158. In such a configuration, when wires are inserted through the openings of the first and second wire receiving portions 144 and 154, they will eventually press against the first and second wire stop portions 152 and 156. This prevents the wires from being over-inserted into the wire-to-wire connector 100. As a result, undesired bending or misshaping of the wires is prevented, and a stable electrical connection between the wires and the contact portion 142 is maintained.

Figure 1E:
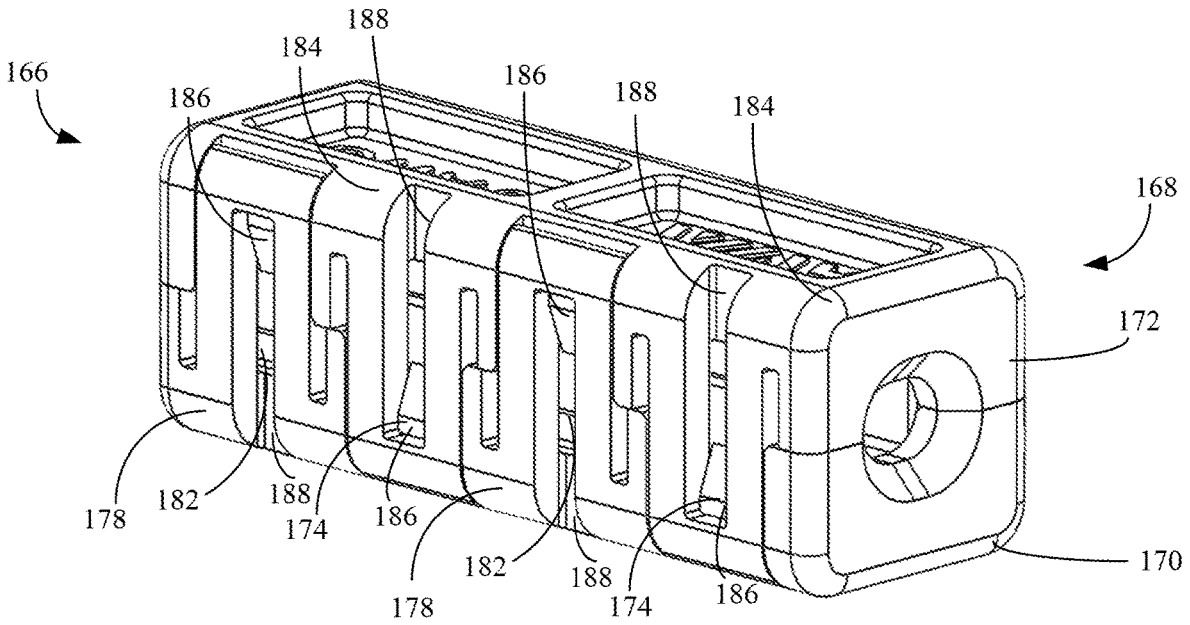
FIG. 1*e* depicts an isometric view of a wire-to-wire connector in accordance with an illustrative embodiment.
Figure 1F:
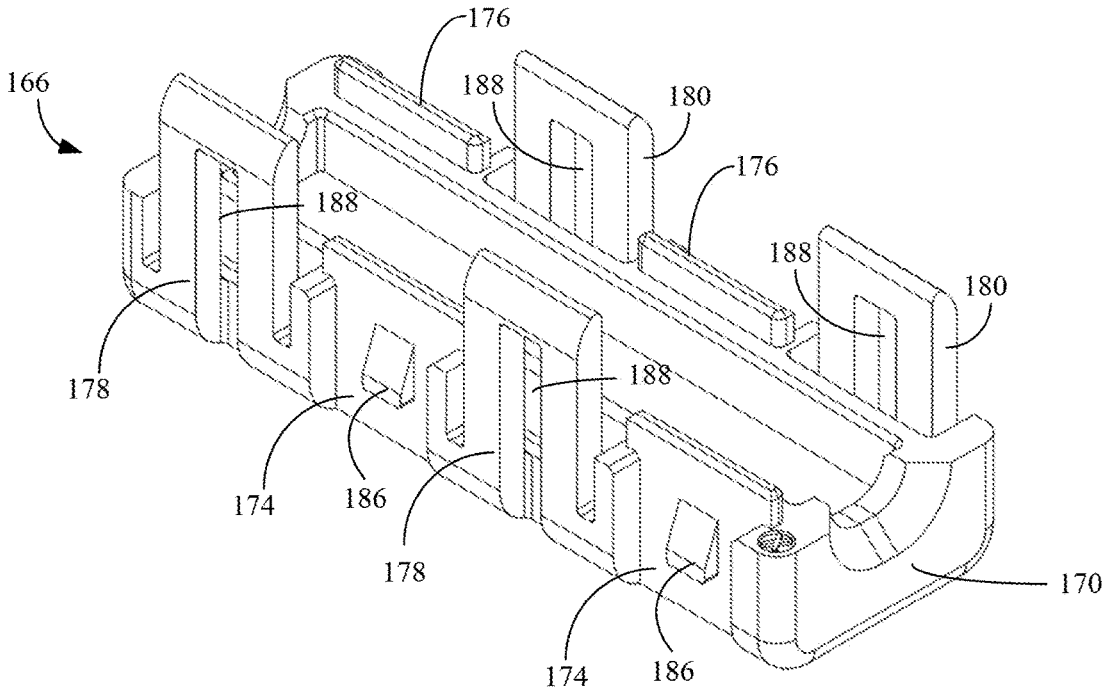
FIG. 1*f* depicts a portion of a housing of a wire-to-wire connector in accordance with an illustrative embodiment.
Figure 1G:
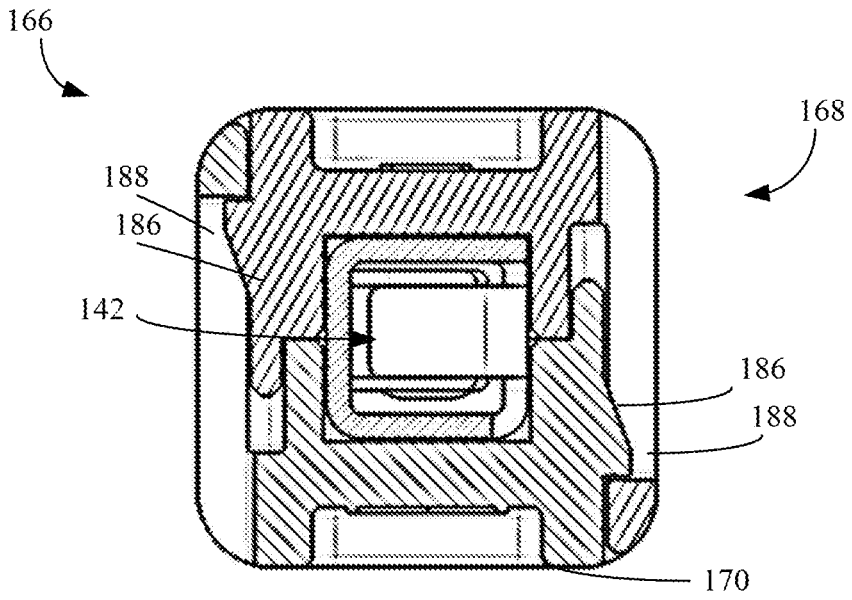
FIG. 1*g* depicts a cross-sectional view of a wire-to-wire connector in accordance with an illustrative embodiment.

Referring to FIGS. 1*e* to 1*g* in general, a wire-to-wire connector 166 is depicted in accordance with an illustrative embodiment. The wire-to-wire connector 166 includes the contact portion 142 described with respect to FIGS. 1*a*-2*d*, but an alternative housing 168. FIG. 1*e* depicts an isometric view of the wire-to-wire connector 166 in accordance with an illustrative embodiment. Figure if depicts an isometric view of a portion 170 of the housing 168 in accordance with an illustrative embodiment. FIG. 1*g* depicts a cross-sectional view of the wire-to-wire connector 166 in accordance with an illustrative embodiment. Similar to the housing 102 described with respect to FIGS. 1*a*-1*d*, the housing 168 includes a first portion 170 and a second portion 172 that interlock with one another to enclose a volume occupied by the contact portion 142.

Similar to the housing 102 described with respect to FIGS. 1*a*-1*d*, the first portion 170 of the housing 168 includes first and second sets of connection cutout portions 174 and 176. Additionally, the first portion 170 includes first and second sets of latching prongs 178 and 180. Likewise, the second portion 172 of the housing 168 also includes a first set of connection cutouts 182 and a second set of connection cutouts (not shown). Also, the second portion 172 includes a first set of latching prongs 184 and a second set of latching prongs (not shown).

In contrast to the housing 102 described with respect to FIGS. 1*a*-1*d*, each connection cutout portion of the housing 168 (i.e. each connection cutout portion in both the first and second portions 170 and 172) includes a wedge 186. Additionally, each latching prong includes a slot 188 configured to receive a wedge 186 of the opposing housing portion. The wedges 186 and the slots 188 are centered in each of the connection cutout portions and latching prongs, respectively. When the first portion 170 is combined with the second portion 172 to complete the assembly of the housing 168, the slots 188 of the second portion 172 are aligned with the wedges 186 of the first portion 170. As shown in FIG. 1*g*, the first and second portions 170 and 172 are then pressed together such that the latching prongs slide over the wedges 186 and surfaces of the slot 188 engage with edges of the wedges 186 to prevent the first portion 170 from being separated from the second portion 172. As such, the combination of the wedges 186 and slots 188 replaces the extending portions and ridges described with respect to FIGS. 1*a*-1*d*.

Since the points of coupling between the first and second portions 170 and 172 (between the wedges 186 and slots 188) are centralized in the housing 168, such an arrangement facilitates insulating the contact portion 142 from external contaminants. When comparing FIG. 1*g* to FIG. 1*b*, it can be seen that arrangement of the connection cutout portions and latching prongs of the housing 168 more tightly surrounds the contact portion 142 with housing material. Thus, the housing 168 more effectively seals off the encapsulated volume than the housing 102. This enables users to take further steps to isolate the contact portion 142. For example, the user may apply a potting compound to the housing 168 to keep moisture out of the internal volume without the potting compound coming into contact with the contact portion 142.

Figure 2A:
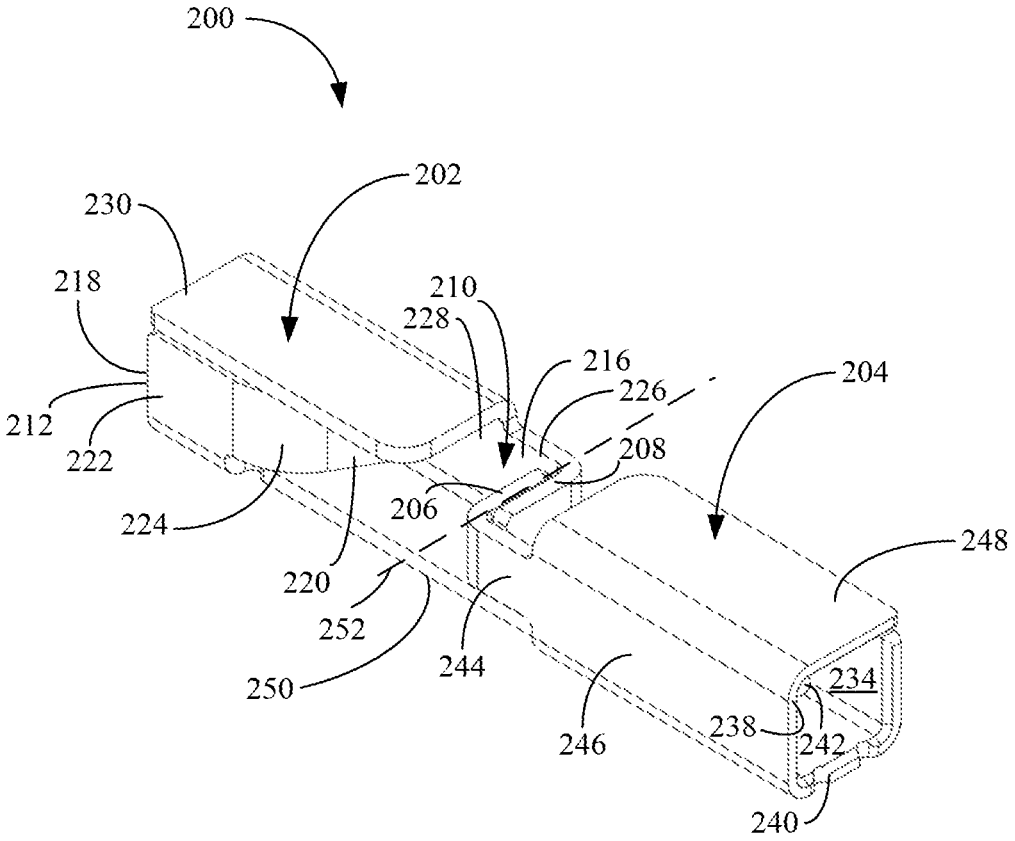
FIG. 2*a* depicts an isometric view of a contact portion of a wire-to-wire connector in accordance with an illustrative embodiment.

FIG. 2*a* depicts an isometric view of a contact portion 200 of a wire-to-wire connector in accordance with an illustrative embodiment. FIG. 2*d* depicts an isometric view of a contact portion 200 of a wire-to-wire connector in accordance with an illustrative embodiment. Referring generally to FIGS. 2*a* and 2*d*, in an embodiment, the contact portion 200 is formed of an electrically-conductive material such as a metal. In an embodiment, the contact portion 200 is manufactured from a single sheet of material that is shaped and folded to form the various structures described below. In alternative embodiments, at least a portion of the contact portion 200 may be formed of a separate piece of material and fixed to another portion via, for example, a welding process.

The contact portion 200 includes a first wire receiving portion 202, a second wire receiving portion 204, and a common wire stop 210 disposed between the first wire receiving portion 202 and the second wire receiving portion 204. In an embodiment, the common wire stop 210 includes a first wire stop portion 206 and a second wire stop portion 208. The first wire receiving portion 202 includes a first surface 212 and a second surface 216. The first surface 212 and the second surface 216 extend from a first end 218 of the first wire receiving portion 202 towards a central axis 252 of the contact portion 200.

The first wire receiving portion 202 further includes a flexing beam 220 extending from the first surface 212 towards the second surface 216 from a bending portion 224 of the first surface 212. Such a configuration facilitates the manufacture of the contact portion 200 from a single sheet of material. Because the flexing beam 220 extends from the bending portion 224, a portion of a sheet of material corresponding to the first surface 212 simply needs to be bent to form the flexing beam 220. Thus, the embodiment shown in FIGS. 2*a*-2*d* facilitates quick and efficient manufacturing of the contact portion 200. With that being said, alternative embodiments are envisioned. For example, in one embodiment, there is a gap between the flexing beam 220 and the first surface 212 (e.g., a portion of the bending portion 224 may be removed to form the gap). Furthermore, referring generally to FIG. 2*d*, in an embodiment, the flexing beam 220 may include a curved cutout 292. The curved cutout 292 allows for the flexing beam 220 to better conform to a corresponding electrical element and hold the corresponding electrical element in place between the flexing beam 220 and the first surface 212. In alternative embodiments, the curved cutout may be square shaped, semicircular shaped, or any other geometry that allows for the flexing beam 220 to receive and hold a corresponding electrical element of a similar geometry.

In an embodiment, an end (not shown) of the flexing beam 220 is displaced from the second surface 216 so as to form a gap between the flexing beam 220 and the second surface 216. In some embodiments, the gap is of a dimension that is less than that of a wire that is to be inserted into the contact portion 200. As will become apparent from the description provided below, such a gap facilitates the flexing beam 220 applying a mechanical force to the wire, thus securing the wire against the second surface 216 to create a secure mechanical and electrical connection between the wire and the contact portion 200.

In an embodiment, the second surface 216 of the first wire receiving portion 202 includes a distal portion 226 and a proximal portion 228. Additionally, the first wire receiving portion 202 also includes a first cover portion 230 that extends from the second surface 216. In the example shown, the first cover portion 230 extends to a dividing boundary between the distal portion 226 and the proximal portion 228. Such an arrangement facilitates the distal portion 226 being bent during the manufacturing process of the contact portion 200. As a result of such a bend, the second wire stop portion 208 may be formed as an extension of the distal portion 226. Further, because the first cover portion 230 does not extend from the distal portion 226, the distal portion 226 is of a lesser height than the proximal portion 228 because of the cutting of the single sheet of material during the manufacturing process.

Still referring to FIG. 2*a*, similar to the first wire receiving portion 202, the second wire receiving portion 204 includes a first surface 234 and a second surface 238. The first surface 234 and the second surface 238 extend from a first end 240 of the second wire receiving portion 204 towards a central axis 252 of the contact portion 200.

The second wire receiving portion 204 further includes a flexing beam 242 extending from the first surface 234 towards the second surface 238 from a bending portion (not shown) of the first surface 234. In an embodiment, an end (not shown) of the flexing beam 242 is displaced from the second surface 238 so as to form a gap between the flexing beam 242 and the second surface 238. In some embodiments, the gap is of a dimension that is less than that of a wire that is to be inserted into the contact portion 200. As will become apparent from the description provided below, such a gap facilitates the flexing beam 242 applying a mechanical force to the wire, thus securing the wire against the second surface 238 to create a secure electrical connection between the wire and the contact portion 200.

In an embodiment, the second surface 238 of the second wire receiving portion 204 includes a distal portion 244 and a proximal portion 246. Additionally, the second wire receiving portion 404 also includes a second cover portion 248 that extends from the second portion 236. In the example shown, the second cover portion 248 extends to a dividing boundary between the distal portion 244 and the proximal portion 246. Such an arrangement facilitates the distal portion 244 being bent during the manufacturing process of the contact portion 200. As a result of such a bend, the first wire stop portion 206 may be formed as an extension of the distal portion 244. Further, because the second cover portion 248 does not extend from the distal portion 244, the distal portion 244 is of a lesser height than the proximal portion 246 because of the cutting of the single sheet of material during the manufacturing process.

In the example shown, the first surface 212 of the first wire receiving portion 202 is placed on a first side of the contact portion 200 and the first surface 234 of the second wire receiving portion 204 is placed on a second side of the contact portion 200. As a result, the flexing beams 220 and 242 extend towards one another over a central axis of the contact portion. Additionally, since the wire stop portions 206 and 208 extend from the distal portions 226 and 244 of the second surfaces 216 and 238, the wire stop portions 206 and 208 also extend towards a central axis of the contact portion 200. In the example shown, the first wire stop portion 206 is disposed on a first side of a central axis 252 nearer the first end 218 of the contact portion 200. The second wire stop portion 208 is disposed on a second side of the central axis 252 nearer the second end 240 of the contact portion 200. The first wire stop portion 206 abuts against the second wire stop portion 208 to form the common wire stop 210.

In various embodiments, a common wire stop 210 is disposed between the first wire receiving portion 202 and the second wire receiving portion 204. As referred to herein, the term "common wire stop" refers to a single structure that is designed to prevent over-insertion of each of the wires that are inserted into the contact portion. The single structure may be constructed of multiple members or elements. In the example shown, the first and second wire stop portions 206 and 208 abut against one another at about the central axis 252 to form the common wire stop 210. Each of the wire stop portions 206 and 208 is substantially planar and extends substantially perpendicularly to a base portion 250 of the contact portion 200. Such an arrangement prevents the user from over-inserting wires into the contact portion 200. If the wire stop portions 206 and 208 are tilted, a force on an inserted wire directed towards the center of the contact portion 200 could potentially force an end of the wire away from a surface of a contact portion (e.g., in the gap resulting from the cover portion 230 not extending from the distal portion 226), resulting in safety concerns or deformation of the wire. However, the wire stop portions 206 and 208 may be tilted without departing from the scope of the present disclosure.

Additionally, the wire stop portions 206 and 208 may be shaped differently than shown in the Figures. For example, in one embodiment, the first and second wire stop portions 206 and 208 may each include a concave surface, with the concavity being directed towards the central axis 252. This way, application of a force directs the wire towards the center of the contact portion 200 and therefore away from any gaps in the contact portion 200. As such, a safe, secure electrical connection between the wire and the contact portion 200 is ensured.

Still referring to FIG. 2*a*, the contact portion 200 further includes a base portion 250. In an embodiment, each of the first surfaces 212 and 234 and second surfaces 216 and 238 surfaces 216 and 238 extend from the base portion 250. In various embodiments, the contact portion 200 may formed from a single sheet of electrically-conductive material. As such, after the single sheet is cut in a shape necessary to form the various features discussed above, the sheet is folded such that the first surfaces 212 and 234 extend substantially perpendicularly to the base portion 250. In an embodiment, the sheet is then folded again such that the combinations of the surfaces 216 and 238 and first and second cover portions 230 and 248 also extend substantially perpendicularly to the base portion 250. These combinations are then folded such that the first and second cover portions 230 and 248 extend substantially perpendicularly to the second surfaces 216 and 238. Finally, the distal portions 226 and 244 are bent to form the wire stop portions 206 and 208. Thus, the structure of the contact portion 200 facilitates an efficient, cost-effective manufacturing process.

In an embodiment, the heights of the first and second surfaces 212, 216, 234, and 238 are equal (i.e., the first and second surfaces 212, 216, 234, and 238 each extend the same vertical distance from the base portion 250). Such a configuration facilitates the first and second cover portions 230 and 248 being flush with the first surfaces 212 and 234 once the first and second cover portions 230 and 248 are bent. As a result, the external surfaces of the contact portion 200 are relatively smooth. These smooth surfaces enable a housing (e.g., the housing 102) to snugly fit around the contact portion 200 so that the electrical connections formed thereby remain secure. With that being said, the heights first and second surfaces 212, 216, 234, and 238 may vary from one another in various other embodiments without departing from the scope of the present disclosure.

In example shown, each of the base portion 250, first and second surfaces 212, 216, 234, and 238, and first and second cover portions 230 or 248 are substantially planar. Such a configuration enables quick manufacture from a single sheet of material. However, the shapes of the base portion 250, first and second surfaces 212, 216, 234, and 238, and first and second cover portions 230 and 248 may vary without departing from the present disclosure. For example, one or more of the base portion 250, first and second surfaces 212, 216, 234, and 238, and first and second cover portions 230 and 248 may include a rounded surface. In an embodiment, each of the base portion 250, first and second surfaces 212, 216, 234, and 238, and first and second cover portions 230 and 248 is rounded such that the first and second wire receiving portions 202 and 204 enclose a substantially cylindrical volume.

Figure 2B:
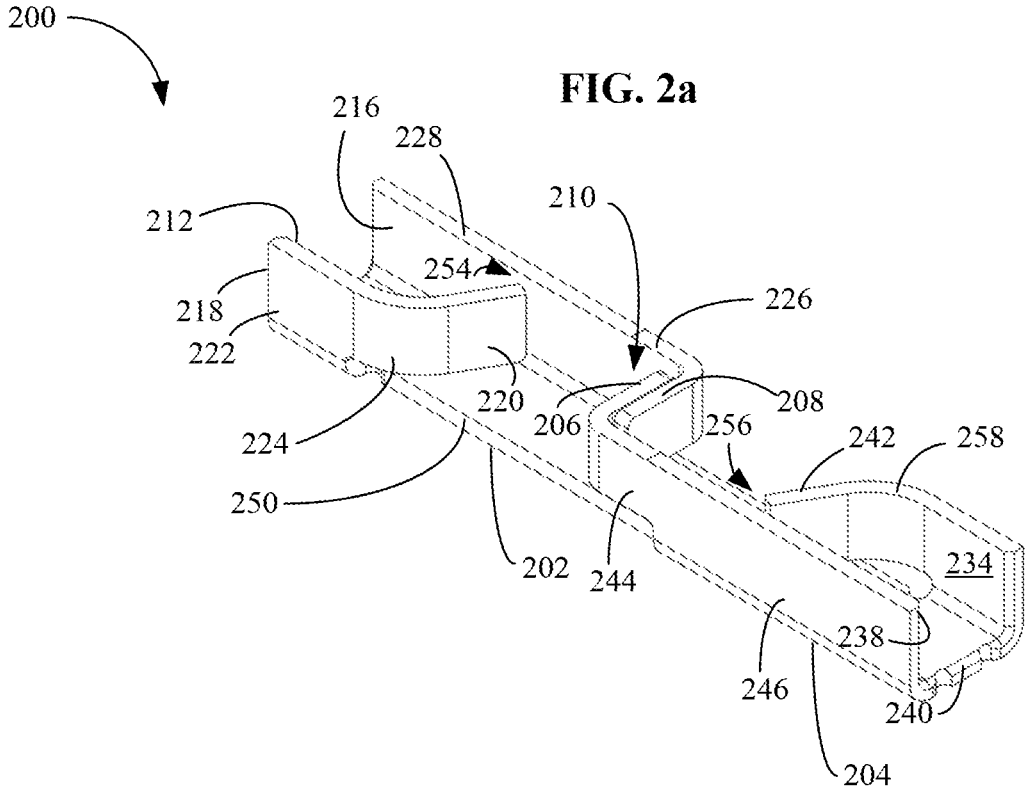
FIG. 2*b* depicts a cross-sectional view of a contact portion of a wire-to-wire connector in accordance with an illustrative embodiment.
Figure 2C:
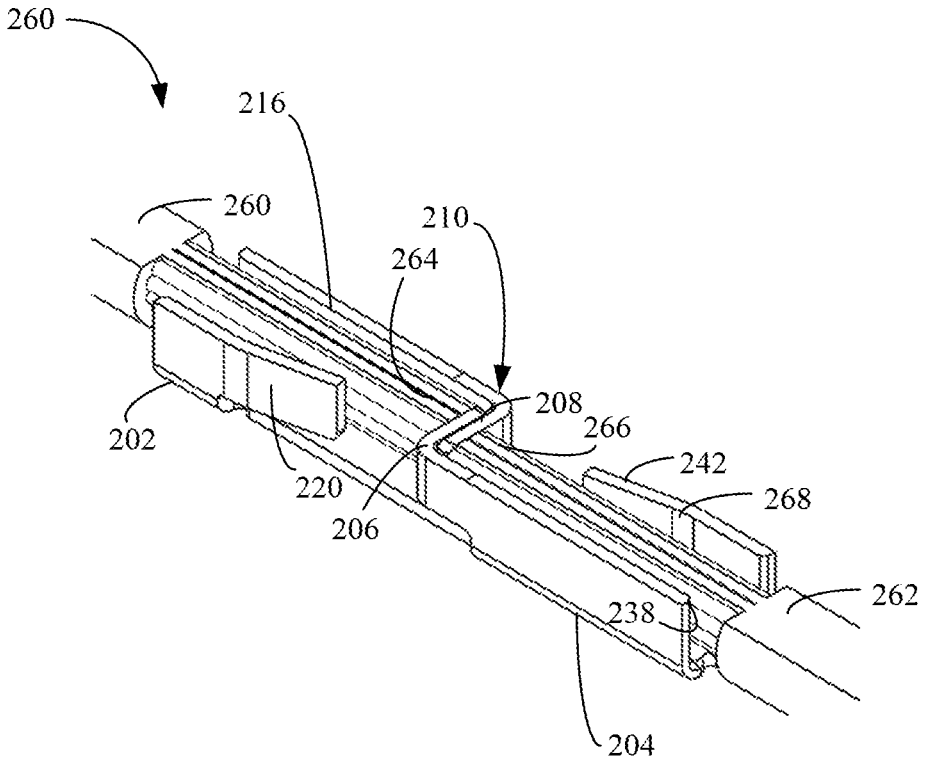
FIG. 2*c* depicts a cross sectional view of a contact portion of a wire-to-wire connector with two wires inserted therein in accordance with an illustrative embodiment.
Figure 2D:
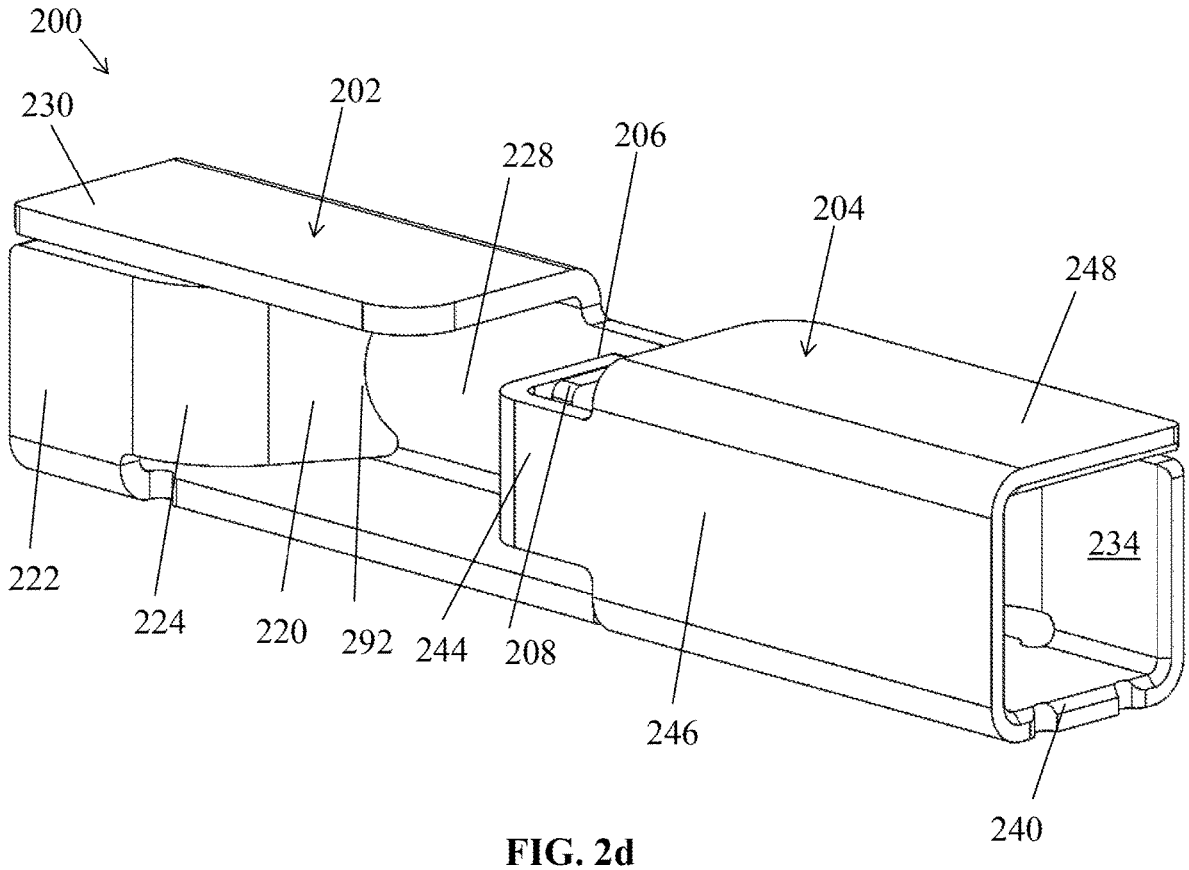
FIG. 2*d* depicts an isometric view of a contact portion of a wire-to-wire connector in accordance with an illustrative embodiment.

FIGS. 2*b* and 2*c* show cross-sectional views of the contact portion 200 in accordance with illustrative embodiments. FIG. 2*a* shows a cross-sectional view in which the first and second cover portions 230 and 248 of the contact portion 200 are removed. FIG. 2*c* shows a cross-sectional view in which the first and second cover portions 230 and 248 of the contact portion 200 are removed and wires 260 and 262 are inserted into the contact portion 200. As shown in FIG. 2*b*, the flexing beams 220 and 242 extend at a first angle from the second surfaces 216 and 238 to form gaps 254 and 256 between ends of the flexing beams 220 and 242 and the second surfaces 216 and 238. The extent of the gaps 254 and 256 may be adjusted based on the degree to which the first surfaces 212 and 234 are bent during the manufacturing of the contact portion 200. Accordingly, the angle to which the bending portions 224 and 258 are bent may be predetermined based on the size of wire that the contact portion 200 is designed to connect with. In some embodiments, the angle to which the bending portions 224 and 258 are bent is a function of the position of the bending portions 224 and 258 relative to the ends 218 and 240 and the heights of the first and second surfaces 212, 216, 234, and 238. For example, the angle to which the bending portions 224 and 258 are bent may be chosen to produce gaps 254 and 256 that are a predetermined percentage of the heights of the first and second surfaces 212, 216, 234, and 238.

In various embodiments, the heights of the first and second surfaces 212, 216, 234, and 238 bear a relationship to the width of the base portion 250. For example, in one embodiment, the heights of the first and second surfaces 212, 216, 234, and 238 are equal to the width of the base portion 250. As such, the openings formed by the first and second wire receiving portions 202 and 204 are substantially square shaped. Such a configuration facilitates the secure insertion of a wire having symmetrical conductors. As will be understood, the heights of the first and second surfaces 212, 216, 234, and 238 may be more or less than the width of the base portion 250 to facilitate secure insertion of differently shaped wires.

In FIG. 2*c*, wires 260 and 262 are inserted into the first and second wire receiving portions 202 and 204. A first wire 260 is inserted into the first wire receiving portion 202. In an embodiment wire 260 is stripped of an amount of an outer insulative layer that is greater than the length of the first wire receiving portion 202. As a result, only an inner conductive portion of the wire 260 is inserted into the contact portion 200. Similarly, a second wire 262 is inserted into the second wire receiving portion 204. In an embodiment wire 262 is stripped of an amount of an outer insulative layer that is greater than the length of the second wire receiving portion 204. As a result, only an inner conductive portion of the wire 262 is inserted into the contact portion 200.

In the example shown, the wires 260 and 262 are inserted through the gaps 254 and 256 until ends 264 and 266 press against the common wire stop 210. Since the gaps 254 and 256 that are formed when no wire is inserted into the contact portion 200 are of a lesser dimension that the inner conduction portions of the wires 260 and 262, the insertion of the wires 260 and 262 causes a displacement of the flexing beams 220 and 242 in a direction away from the second surfaces 216 and 238. Such displacement places a tensile strain on the flexing beams 220 and 242 as well as the bending portions 224 and 258 of the first surfaces 212 and 234. As a result, the contact portion 200 mechanically forces the ends 264 and 266 of the wires 260 and 262 into the second surfaces 216 and 234. Since the contact portion 200 is constructed of an electrically conductive material and the outer insulative layers of the wires 260 and 262 are removed, a secure, reliable electrical and mechanical connection between the wires 260 and 262 is created.

Additionally, the structure of the common wire stop 210 further facilitates the electrical connection between the wires 260 and 262. In the embodiment shown, the first wire stop portion 206 extends from the distal portion 244 of the second surface 238 of the second wire receiving portion 204. Since the second wire 262 is pressed against the second surface 238 by the contact beam 242, the common wire stop 210's structure provides an additional point of electrical coupling between the wires 260 and 262 because the first wire 260 is also electrically connected to the second surface 238 via the mechanical force provided by the flexing beam 242. Thus, the unique, single-piece design of the contact portion 200 enables multiple points of electrical contact between the wires 260 and 262.

Figure 3:
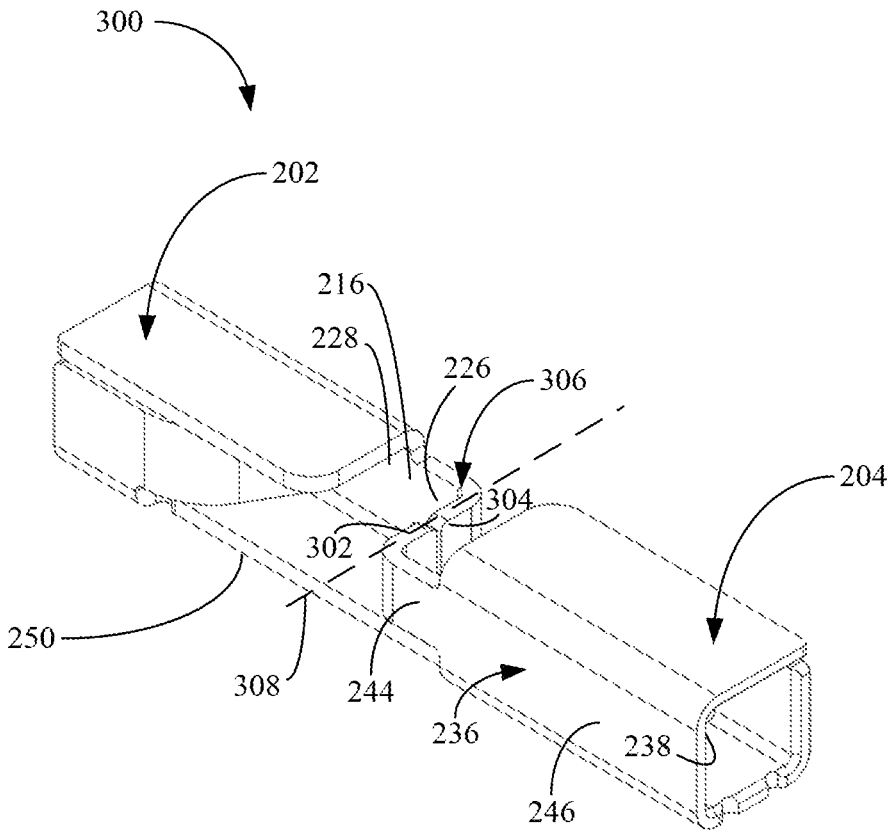
FIG. 3 depicts an isometric view of a contact portion of a wire-to-wire connector in accordance with an illustrative embodiment.

Referring now to FIG. 3, an isometric view of a contact portion 300 is shown in accordance with an illustrative embodiment. The contact portion 300 is an alternative to the contact portion 200 shown in FIGS. 2*a*-2*c*. In an embodiment, the contact portion 300 shares many features with the contact portion 200. Accordingly, like references numerals are used in FIG. 3 to refer to such similar features. The contact portion 300 differs from the contact portion 200 primarily in the configuration of the wire stop. In contrast to the contact portion 200 discussed above, the contact portion 300 includes a common wire stop 306 that includes a first wire stop portion 302 and a second wire stop portion 304 that are substantially co-planar at about a central axis 308 of the contact portion 300. In alternative embodiments, the common wire stop 306 may not be at the central axis 308, but offset from the central axis 308.

The first wire stop portion 302 extends from the distal portion 244 of the second surface 238 of the second wire receiving portion 204 towards the center of the contact portion 300. In an embodiment, the first wire stop portion 302 extends approximately half the distance between the distal portion 244 of the second surface 238 of the second wire receiving portion 204 and the distal portion 226 of the second surface 216 of the first wire receiving portion 202. The second wire stop portion 304 extends from the distal portion 226 of the second surface 216 of the first wire receiving portion 202 towards the center of the contact portion 300. In an embodiment, the second wire stop portion 304 also extends approximately half the distance between the distal portion 226 of the second surface 216 of the first wire receiving portion 202 and the distal portion 244 of the second surface 238 of the second wire receiving portion 204. As such, an end of the first wire stop portion 302 meets the end of the second wire stop portion 304 about at the center of the contact portion 300.

Similar to the contact portion 200 discussed above, the contact portion 300 may be manufactured from a single sheet of electrically-conductive material such as a metal. As such, the sheet of material may be cut and folded to form the contact portion 300. During the cutting and folding process, the portion of the sheet used to form the second surface 238 of the second wire receiving portion 204, for example, may be folded from the base portion 250 such that the second surface 238 extends substantially perpendicularly to the base portion 250. Also, the portion of the sheet used to form the distal portion 244 may also be folded to create the first wire stop portion 302. A similar set of folds is made for the portion of sheet used to form the second surface 216 of the first wire receiving portion 202.

While the configuration of the wire stop portions 302 and 304 is consistent with the present disclosure, the configuration of the wire stop portions 206 and 208 described with respect to FIGS. 2*a*-2*b* are preferred. As described herein, each of the contact portions 200 and 300 may be constructed from a single sheet of material by cutting and stamping the material. The material used (e.g., a sheet metal) has a resilience to pressing. As such, upon pressing the material to create various bends in the contact portions 200 and 300, the material bends back. Given this, during the manufacturing process, it is desirable to bend the material at angles greater than the final angles desired of the contact portions 200 and 300. In the arrangement of FIG. 3, since the wire stop portions 302 and 304 abut against one another, one cannot over-bend the contact portion 300, resulting in an undesired gap between the wire stop portions 302 and 304, reducing the efficacy of the common wire stop 306 in preventing the over-insertion of wires. Thus, the configuration shown in FIGS. 2*a*-2*b* is preferred because the material may be over-pressed to form a wire stop portion 200 having desired angles, resulting in no gaps in the common wire stop 210. Additionally, since the wire stop portions 206 and 208 overlap with one another, they re-inforce each other. Such re-enforcement strengthens the common wire stop 210, preventing the user from overcoming the resistance provided by the common wire stop 210 and over-inserting wires.

Figure 4:
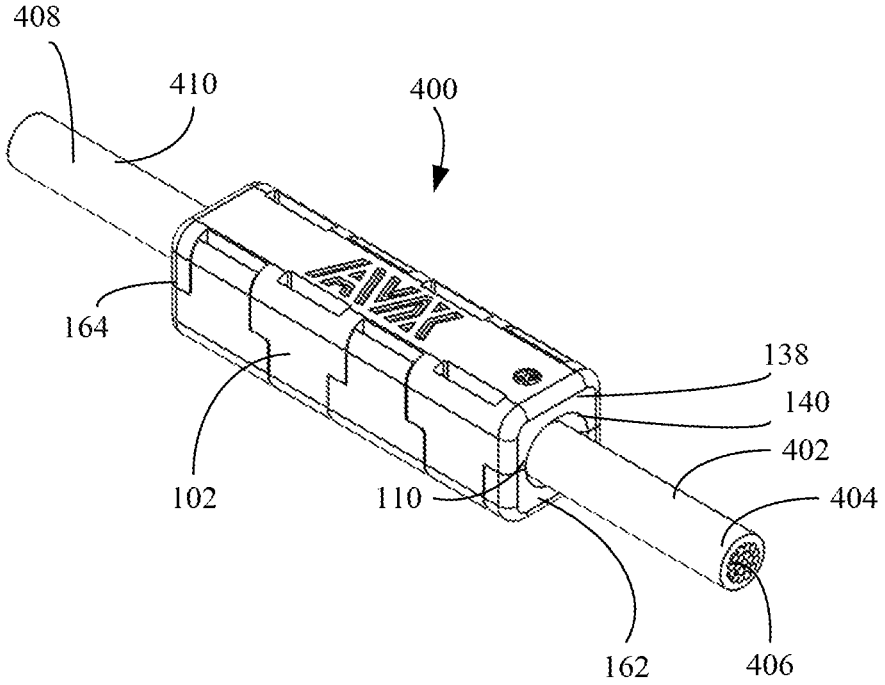
FIG. 4 depicts an isometric view of a wire-to-wire connector with wires inserted therein in accordance with an illustrative embodiment.

Turning now to FIG. 4, a wire-to-wire connector 400 is shown in accordance with an illustrative embodiment. The wire-to-wire connector 400 includes the housing 102 discussed above. Accordingly, like reference numerals used above in relation to FIGS. 1*a*-1*d* are used to indicate such like features. The wire-to-wire to connector 400 may include either of the contact portions 200 or 300 discussed above.

In the example shown, a first wire 402 passes through a first wire opening 110 at a first end 162 of the housing 102. The first wire 402 is securely connected to a surface of a contact portion (e.g., the surface 216 of the contact portion 200) by a flexing beam (e.g., the flexing beam 220 of the contact portion 200). To create such a secure connection, a first end of the first wire 402 is inserted through the wire opening 110 and pressed against the flexing beam until a portion the first wire 402 slides through a gap (e.g., the gap 254) between the flexing beam and the surface and against a portion of a wire stop (e.g., the first wire stop portion 206) of the contact portion. As a result, the flexing beam presses the first wire 402 against the surface of the contact portion, thereby simultaneously creating a mechanical and electrical connection between the first wire 402 and the contact portion. Similarly, a second wire 408 passes through a second wire opening (not shown) at a second end of the housing 102. A similar process is used to create a secure electrical and mechanical connection between the second wire 408 and the contact portion.

In the example shown, the first wire 402 includes an outer insulative layer 404 and a conductive core 406. The conductive core 406 may include any known arrangement of conductors. The second wire 408 also includes an outer insulative layer 410 and a conductive core (not shown). In an embodiment, the portions of the outer insulative layers 404 and 410 of the wires 402 and 404 are removed from the ends of the wires 402 and 404 that are inserted into the wire-to-wire connector 400. As a result, the conductive cores of the wires 402 and 404 are pressed against the electrically-conductive contact portion, and an electrical connection is created between the wires 402 and 408. In the example shown, the entirety of the portions of the wires 402 and 404 that extend outwardly from the wire-to-wire connector 400 have not been stripped of their outer insulative layers. Such an arrangement minimizes safety concerns of exposed conductive cores.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed is:

1. A connector comprising:

a first wire receiving portion comprising a first contact beam;

a second wire receiving portion comprising a second contact beam; and a wire stop between the first wire receiving portion and the second wire receiving portion, wherein the wire stop includes a first wire stop portion and a second wire stop portion, and wherein the first wire stop portion abuts the second wire stop portion, and wherein the first wire stop portion is substantially co-planar to the second wire stop portion in a direction substantially parallel to a central axis of the connector.

2. The connector of claim 1, wherein the first contact beam extends from a first surface of the first wire receiving portion toward a second surface of the first wire receiving portion opposite the first surface.

3. The connector of claim 2, wherein the first contact beam includes a first end that is displaced from the second surface to form a gap between the first end and the second surface.

4. The connector of claim 3, wherein the first surface of the first wire receiving portion is disposed on a first side of the connector and a first surface of the second wire receiving portion is disposed on a second side of the connector.

5. The connector of claim 4, wherein the first contact beam extends in a first direction toward the second side of the connector, and wherein the second contact beam extends in a second direction toward the first side of the connector.

6. The connector of claim 1, wherein the first wire stop portion abuts the second wire stop portion at a central axis of the connector.

7. The connector of claim 1, wherein the first wire receiving portion comprises a first surface and a second surface extending from an end of the first wire receiving portion, wherein the first contact beam extends from the first surface of the first wire receiving portion toward the second surface of the first wire receiving portion, wherein the second wire receiving portion comprises a first surface and a second surface extending from an end of the second wire receiving portion, and wherein the second contact beam extends from the first surface of the second wire receiving portion toward the second surface of the second wire receiving portion.

8. The connector of claim 7, wherein the first wire stop portion extends from the second surface of the first wire receiving portion toward the second surface of the second wire receiving portion and the second wire stop portion extends from the second surface of the second wire receiving portion toward the second surface of the first wire receiving portion.

9. The connector of claim 1, further comprising a base portion extending from an end of the first wire receiving portion to an end of the second wire receiving portion.

10. The connector of claim 1, wherein the first wire receiving portion comprises a first cage-like structure configured to receive a first wire, wherein the first contact beam extends from the first cage-like structure, wherein the second wire receiving portion comprises a second cage-like structure configured to receive a second wire, and wherein the second contact beam extends from the second cage-like structure.

11. A connector comprising:

a first wire receiving portion comprising a first contact beam;

a second wire receiving portion comprising a second contact beam; and a wire stop between the first wire receiving portion and the second wire receiving portion, wherein the wire stop includes a first wire stop portion and a second wire stop portion, and wherein the first wire stop portion abuts the second wire stop portion; and wherein the first wire stop portion and the second wire stop portion overlap.

12. The connector of claim 11, wherein the first wire receiving portion comprises a first surface and a second surface extending from an end of the first wire receiving portion, wherein the first contact beam extends from the first surface of the first wire receiving portion toward the second surface of the first wire receiving portion, wherein the second wire receiving portion comprises a first surface and a second surface extending from an end of the second wire receiving portion, and wherein the second contact beam extends from the first surface of the second wire receiving portion toward the second surface of the second wire receiving portion; and wherein the first wire stop portion extends from the second surface of the first wire receiving portion toward the second surface of the second wire receiving portion and the second wire stop portion extends from the second surface of the second wire receiving portion toward the second surface of the first wire receiving portion such that the first and second wire stop portions overlap.

13. A system comprising:

an insulative housing; and an electrically-conductive contact disposed within the insulative housing, the electrically-conductive contact comprising:

a first wire receiving portion proximate a first end of the insulative housing;

a second wire receiving portion proximate a second end of the insulative housing;

a first contact beam extending from the first wire receiving portion toward the second wire receiving portion; and a second contact beam extending from the second wire receiving portion toward the first wire receiving portion; and a wire stop disposed between the first wire receiving portion and the second wire receiving portion, wherein the wire stop includes a first wire stop portion abutting a second wire stop portion, and wherein the first wire stop portion and the second wire stop portion overlap.

14. The system of claim 13, wherein the insulative housing comprises a first portion and a second portion, the first portion interlocking with the second portion to form a first wire opening aligned with an opening of the first wire receiving portion and a second wire opening aligned with an opening of the second wire receiving portion.

15. The system of claim 14, further comprising a first gap between the first wire opening and a volume enclosed by the first wire receiving portion and a second gap between the second wire opening and a volume enclosed by the second wire receiving portion.

16. The system of claim 13, wherein the first wire opening is of a first diameter and the second wire opening is of a second diameter different from the first diameter.

17. The system of claim 14, wherein the first portion of the insulative housing comprises:

a first latching prong and a first connection cutout portion; and a second latching prong and a second connection cutout portion, wherein the first latching prong and the first connection cutout portion are offset from the second latching prong.

18. The system of claim 17, wherein the second portion of the insulative housing includes:

a first latching prong and a first connection cutout portion; and a second latching prong and a second connection cutout portion, wherein the first latching prong of the first portion of the insulative housing is engaged with the first connection cutout portion of the second portion of the insulative housing to secure the first portion of the insulative housing to the second portion of the insulative housing.

19. The system of claim 18, wherein the first latching prongs of the first and second portions of the insulative housing comprise teeth extending toward a center of the insulative housing, and wherein the first connection cutout portions of the first and second portions of the insulative housing include ridges configured to engage the teeth.

20. A system comprising:

an insulative housing; and an electrically-conductive contact disposed within the insulative housing, the electrically-conductive contact comprising:

a first wire receiving portion proximate a first end of the insulative housing;

a second wire receiving portion proximate a second end of the insulative housing;

a first contact beam extending from the first wire receiving portion toward the second wire receiving portion; and a second contact beam extending from the second wire receiving portion toward the first wire receiving portion; and a wire stop disposed between the first wire receiving portion and the second wire receiving portion, wherein the wire stop includes a first wire stop portion abutting a second wire stop portion;

wherein the first end comprises a first outer surface that includes a planar portion and an angled portion, the planar portion of the first outer surface surrounding the angled portion, and wherein the first wire opening is within the angled portion.

* * * * *